US005955714A

United States Patent [19]

Reneau

[11] Patent Number: 5,955,714

[45] Date of Patent: Sep. 21, 1999

[54] ROLL-OVER SHUNT SENSOR

[75] Inventor: Daniel R. Reneau, Madison, Wis.

[73] Assignee: Breed Technologies, Inc., Lakeland, Fla.

[21] Appl. No.: 09/082,046

[22] Filed: May 20, 1998

[51] Int. Cl.[6] ..... H01H 35/02

[52] U.S. Cl. ..... 200/61.52; 200/61.45 M; 200/61.45 R; 335/205; 335/206; 335/207

[58] Field of Search ..... 335/205–207; 200/61.45 M, 61.45 R, 61.52

[56] References Cited

U.S. PATENT DOCUMENTS

| | | | |
|---|---|---|---|
| 3,051,805 | 8/1962 | Binford . | |
| 3,180,952 | 4/1965 | Preisz . | |
| 3,327,079 | 6/1967 | Widl . | |
| 3,725,896 | 4/1973 | Wagner . | |
| 3,737,599 | 6/1973 | Zuvela | 200/61.45 R |
| 3,778,572 | 12/1973 | Matsui et al. . | |
| 3,795,780 | 3/1974 | Lawrie . | |
| 3,814,875 | 6/1974 | Takada . | |
| 4,016,535 | 4/1977 | Dinlocker . | |
| 4,103,842 | 8/1978 | Martin et al. . | |
| 4,258,353 | 3/1981 | Carlson . | |
| 4,275,391 | 6/1981 | Okamura . | |
| 4,726,627 | 2/1988 | Frait et al. . | |
| 4,820,888 | 4/1989 | Shields . | |
| 4,866,379 | 9/1989 | Odagawa et al. . | |
| 4,910,459 | 3/1990 | Odagawa et al. . | |
| 5,010,216 | 4/1991 | Sewell et al. . | |
| 5,149,926 | 9/1992 | Ono . | |
| 5,237,134 | 8/1993 | Thuen et al. . | |
| 5,248,861 | 9/1993 | Kato et al. | 200/61.45 M |
| 5,283,402 | 2/1994 | Green . | |
| 5,285,031 | 2/1994 | Schueneman . | |
| 5,285,032 | 2/1994 | Robinette . | |
| 5,293,523 | 3/1994 | Posey . | |
| 5,307,699 | 5/1994 | Engdahl et al. . | |
| 5,373,124 | 12/1994 | Abendroth et al. | 200/61.45 R |
| 5,378,865 | 1/1995 | Reneau . | |
| 5,416,293 | 5/1995 | Reneau | 200/61.45 M |
| 5,450,049 | 9/1995 | Bachmann . | |
| 5,581,060 | 12/1996 | Kobayashi et al. . | |
| 5,664,665 | 9/1997 | Kobayashi et al. | 200/61.45 M |

*Primary Examiner*—Michael L. Gellner
*Assistant Examiner*—Tuyen T. Nguyen
*Attorney, Agent, or Firm*—Lathrop & Clark

[57] ABSTRACT

A ferromagnetic shunt is pivotally mounted to a housing to form a pendulum which swings between a reed switch and a magnet. As long as the shunt remains between the reed switch and the magnet the reed switch remains open. The shunt is held or biased between the magnet and the reed switch by the force of the magnetic attraction between the shunt and the magnet. The mass of the shunt acts as both a tilt sensor which responds to gravity and an accelerometer sensitive to crash-induced accelerations. The reed switch, magnet and shunt are mounted in a housing which positions the reed switch and magnet and controls the maximum range of motion of the shunt. The magnet is located between two sidewardly spaced pendulum arms, which allow the shunt to swing out from between the reed switch and the magnet in two opposite directions.

12 Claims, 3 Drawing Sheets

ROLL-OVER SHUNT SENSOR

FIELD OF THE INVENTION

The present invention relates to shock sensors in general and to shock sensors used for engaging or deploying automobile safety devices in particular.

BACKGROUND OF THE INVENTION

Shock sensors are used in motor vehicles, including cars and aircraft, to detect vehicle collisions. When such a collision occurs, the shock sensor triggers an electronic circuit for the actuation of one or more safety devices. One type of safety device, the deployable air bag, has found widespread acceptance by consumers as improving the general safety of automobile operation. Air bags have gone from an expensive option to standard equipment in many automobiles. Further, the number of air bags has increased from a single driver's side air bag to passenger air bags. Future use of multiple air bags is a distinct possibility.

With the ever increasing utilization of air bags, research and development has continued with efforts to make air bags and the electronics and sensors which control their deployment both more reliable and of lower cost. A key aspect of reliability with respect to air bags involves the twin, somewhat conflicting requirements that the air bag deploy in every situation where deployment would be advantageous to the passengers but, at the same time, not deploy except when actually needed. Reliable deployment of an air bag without unwanted deployments is facilitated by use of multiple sensors in combination with actuation logic which can assess the nature and direction of the crash as it is occurring and, based on preprogrammed logic, make the decision whether or not to deploy the air bag. This increase in reliability tends to lead to a greater number of sensors as well as increased use of electronic logic.

The desire to hold down sensor cost and to keep the sensor integrated with the logic circuits has led to the use of solid state shock sensors. However, solid state shock sensors are prone to losing touch with the real world and may occasionally indicate a crash is occurring due to radio frequency interference, electronic noise, cross-talk within the electronics, etc.

The ability of mechanical shock sensors as an integral part of bag deployment systems to prevent unnecessary bag deployment has kept demand for mechanical shock sensors high.

A number of types of shock sensors employing reed switches have been particularly advantageous in combining a mechanical shock sensor with an extremely reliable electronic switch which, through design, can be made to have the necessary dwell times required for reliable operation of vehicle safety equipment. The reed switch designs have also been of a compact nature such that the switches may be readily mounted on particular portions of the vehicle which, in a crash, will experience a representative shock which is indicative of the magnitude and even the direction of the shock-inducing crash.

Typically, shock sensors have sensed crash magnitude and direction. Information about the type of crash a vehicle is experiencing is then used by safety equipment logic to deploy air bags or retract seat belts, etc. One result of a vehicle crash or accident can be an over turning, or roll-over of the vehicle. Such events may be preceded by a side impact or may be the result of a loss of control of the vehicle. In either case a side crash load may or may not be detected prior to the vehicle entering a roll. If safety equipment logic is to consider the implications of vehicle roll-over in deploying safety equipment, then sensors must be provided which can reliably indicate a roll-over has occurred or is occurring. Typically integrated accelerometers and rate sensors are employed to characterize vehicle dynamics. However, such solid state devices are subject to electromagnetic interference.

What is needed is a mechanical roll-over sensor

SUMMARY OF THE INVENTION

A shunt is pivotally mounted to form a pendulum positioned between a reed switch and a magnet. The shunt is formed of ferromagnetic material and is mounted such that as long as it remains between the reed switch and the magnet the reed switch remains open. The shunt is held or biased between the magnet and the reed switch by the force of the magnetic attraction between the shunt and the magnet. The mass of the shunt acts as both a tilt sensor which responds to gravity and an accelerometer sensitive to crash-induced accelerations. The reed switch, magnet and shunt are mounted in a housing which positions the reed switch and magnet and controls the maximum range of motion of the pendulum-mounted shunt.

It is a feature of the present invention to provide an electromechanical sensor which can detect vehicle roll-over and crash shocks leading to vehicle roll-over.

It is a further feature of the present invention to provide a sensor for detecting vehicle roll-over which is less sensitive to electromagnetic interference.

It is another feature of the present invention to provide a shock sensor for use in a vehicle safety system.

Further objects, features and advantages of the invention will be apparent from the following detailed description when taken in conjunction with the accompanying drawings.

DESCRIPTION OF THE PREFERRED EMBODIMENT

Figure 1:
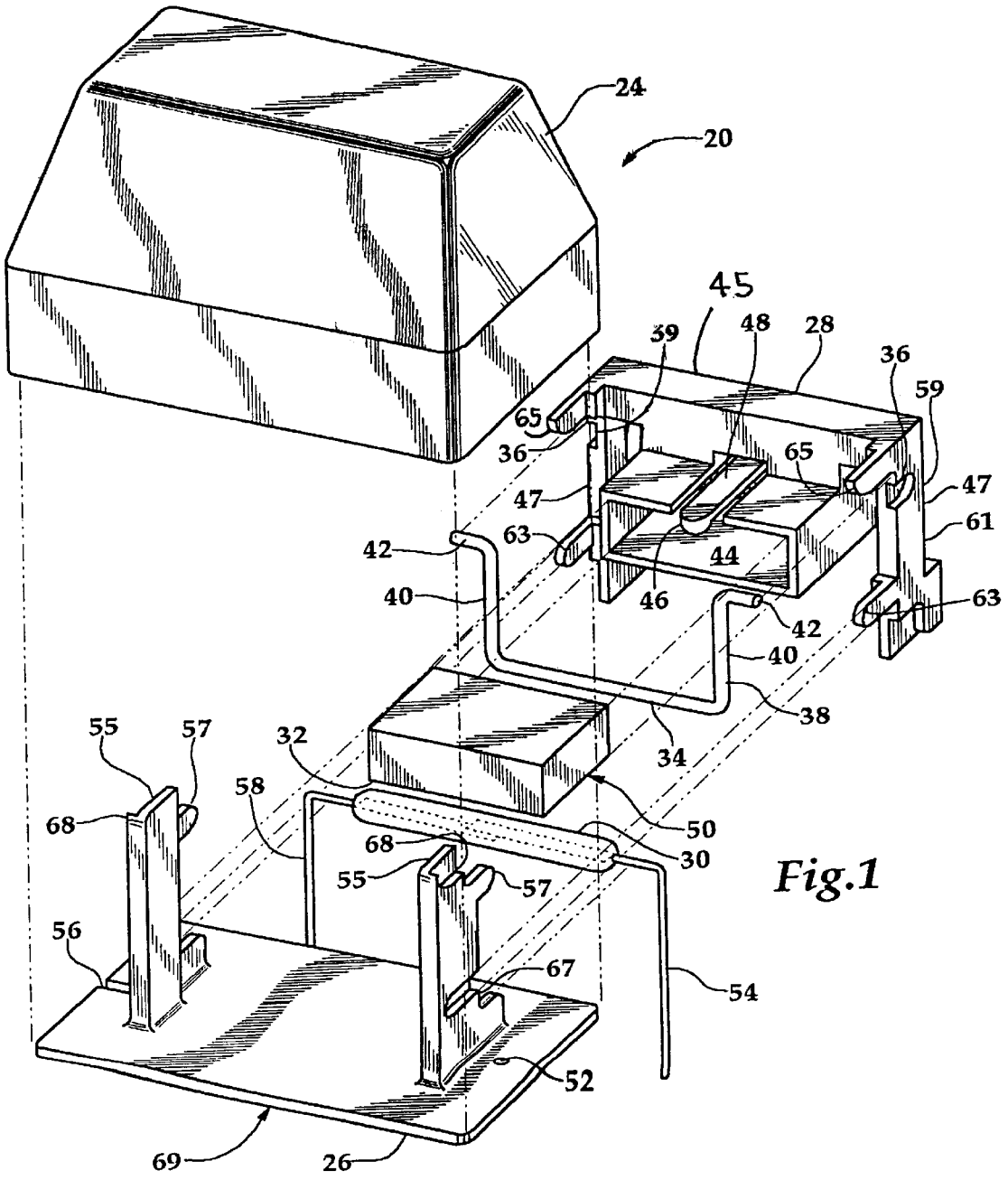
FIG. 1 is an exploded perspective view of the sensor of this invention.
Figure 2:
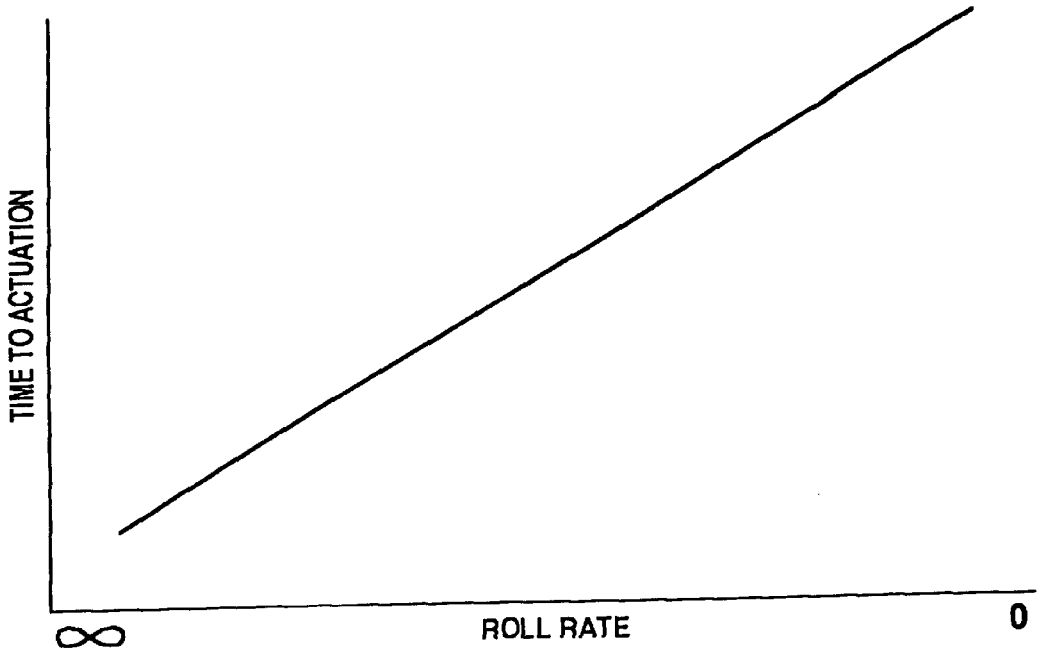
FIG. 2 is a graph of time to actuate vs. roll rate.
Figure 3:
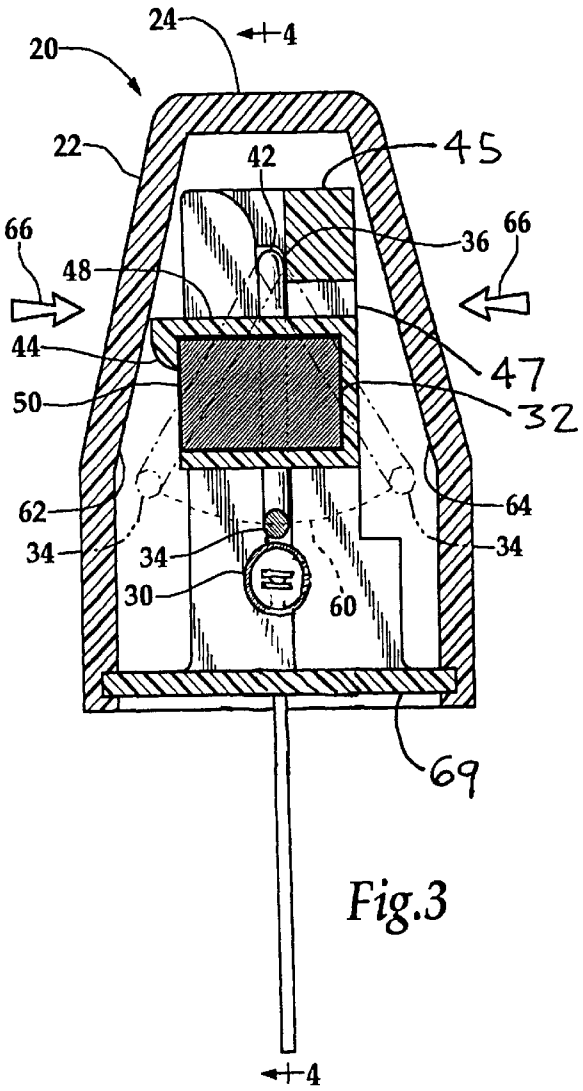
FIG. 3 is a cross sectional view of the sensor of FIG. 1, taken perpendicular to the axis of the reed switch and through the centerline of the device.
Figure 4:
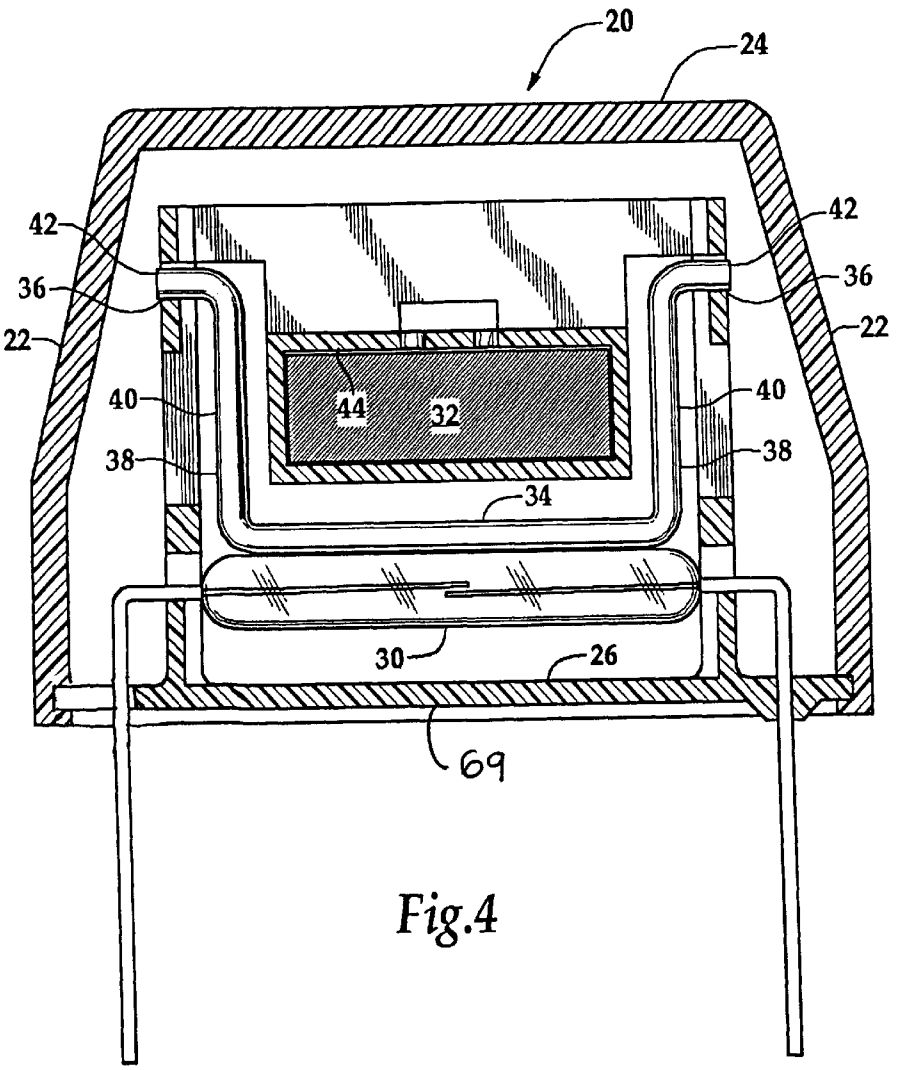
FIG. 4 is a cross-sectional view of the device of FIG. 3, taken along section line 4—4.

Referring more particularly to FIGS. 1–4, wherein like numbers refer to similar parts a tilt sensor 20 is shown in FIGS. 3 and 4. The tilt sensor 20 has a plastic housing 22 which is composed of a base 26 and connected magnet housing 28 both enclosed within a cover 24. The functional components of the tilt sensor 20 are a reed switch 30 fixed to the housing, a magnet 32 positioned above the reed switch 30, and a shunt 34 which is hung from pivot points 36 on the housing defined between the connected base 26 and the magnet housing 28. The shunt 34 hangs in a neutral position between the reed switch 30 and the magnet 32 when the sensor 20 is in a vertical position as shown in FIG. 3.

The housing 22 and its components are constructed of plastic although the cover 24 could incorporate a magnetic shield. The shunt 34 may be formed as part of a trapeze member 38, consisting of the shunt member 34 which is a horizontal bar, and two vertical pendulum arms 40 terminating at coaxial pivot portions 42. The shunt 34 is constructed of ferromagnetic material, for example an alloy similar to that of which reed switch reads are constructed. The ferromagnetic shunt 34 prevents the magnetic field produced by the magnet from causing the reed switch 30 to close.

The shunt 34 is held between the reed switch 30 and the magnet 32 by gravity and magnetic attraction between the shunt 34 and the magnet 32. A force produced by gravity when the tilt sensor 20 is tilted or by a shock with a component perpendicular to an axis defined by the pivot points 36 can cause the shunt 34 to pivot about the pivot portions 42 of the trapeze member 38. Pivoting of the trapeze member 38 causes the shunt 34 to move out from between the reed switch 30 and the magnet 32 which allows the magnetic field produced by the magnet to cause the reed switch to close.

For simplicity of construction, the entire trapeze member 38 can be constructed of a ferromagnetic material but it is preferable to have only the shunt 34 constructed of ferromagnetic material and the other portions of the trapeze member 38 constructed of copper or other nonmagnetic material.

As shown in FIG. 1, the magnet 32 is retained on the magnet housing 28 in a pocket 44. The pocket 44 depends from a cross beam 45 which is elevated above the base on two vertical supports 47. This overhead support of the pocket 44 allows the shut 34 to swing freely on the pendulum arms 40 from out between the reed switch and the magnet in two opposite directions, making the sensor 20 capable of bi-directional activation. A resilient clip 46 is integral with the magnet housing 28 and has a resilient arm 48 which holds the magnet within the pocket 44. The magnet 32 has two poles aligned along the axis defined by the reed switch, and both poles are on the face 50 of the magnet 32 facing the reed switch 30.

The base 26 has a lead hole 52 through which the first reed switch lead 54 passes. A slot 56 opposite the lead hole 52 receives the second lead 58 of the reed switch 30. Thus, the lead hole 52 together with portions of the base 26 and magnet housing 28 position the reed switch 30 with respect to the shunt 34 and the magnet 32. The leads 54, 58 allow the sensor 20 to be directly mounted to a circuit board (not shown).

The base 26 has two upstanding arms 55. Each arm has a projecting thumb 57 which mates with a slot 59 in the magnet housing 28. The thumbs 57 define supports on which the coaxial portions 42 of the trapeze 38 pivot. The magnet housing 28 has two vertical legs 61 which have lower tabs 63 and upper tabs 65 which mate with corresponding lower slots 67 and upper slots 68 which accurately position and lock together the magnet housing 28 and the base 26. The interlocking features of the base 26 and the magnetic housing 28 hold the hold the base 26 and magnetic housing 28 together until the cover 24 is installed. The cover 24 surrounds and holds together the base 26 and the magnet housing 28. A tight fit between the cover 24 and the bottom 69 of the base 26 forms a recess as shown in FIGS. 3 and 4 which is filled with epoxy to seal and connect the bottom 69 to the cover 24.

Operation of the sensor 20 requires a balance between magnetic sensitivity if of reed switch 30, the strength of the magnet 32, the size and mass of the shunt 34, the length of the pendulum arms 40 and the geometric spacing between components. The pendulum mass, which as illustrated is coincident with the shunt 34, controls the force produced by gravity attempting to pivot the shunt 34 along an arc 60 shown in FIG. 3 when the housing is tilted so that gravity causes the pendulum to swing out along the arc 60. The inner walls 62, 64 of the housing cover form stops which limit the maximum travel of the shunt 34.

The sensor 20 will typically be employed together with integrated chip sensors which are executed in silicon lithography. Integrated chip sensors can accurately detect linear and angular accelerations. However, they are subject to spurious signals produced by electromagnetic interference and other sources of stray voltages. The sensor 20 provides both an indication of vehicle tilt and angular acceleration which is less subject to spurious outputs. By combining information from mechanical and integrated circuit devices a better understanding of vehicle dynamics can be produced.

FIG. 2 shows how a sensor such as the one shown in FIGS. 1, 3, and 4 might be designed to react to angular accelerations such as produced by forces aligned with arrows 66 as shown in FIG. 3. As the roll rate approaches zero a response time exists for angular displacement, as roll rate approaches infinity, time to activation approaches zero limited to a predetermined extent by an amount of damping presented by friction, gas or fluid within the housing In situations where a vehicle rolls over, the actual rollover may or may not be preceded by a shock load such as is produced by an impact. Thus the advantage of a sensor which can directly measure vehicle tilt as well as side impact. Because of the relationship between angular rate and activation time as shown by FIG. 4, an angular rate of an integrated chip sensor can be directly compared to activation time for the electromechanical sensor 20.

It should be understood that the shunt 34 can be increased in size so as to continue to act as a shunt when displaced by a small angular motion of the trapeze. Further increasing the size of the shunt to increase its mass also serves to increase the force of gravity which acts to displace the shunt, relative to magnetic restoring forces, when the sensor is tilted.

It should be understood that the magnet may have varying arrangement and placement of poles and that the strength of the magnet may be varied. It should also be understood that a spring, for example a torsion spring could be positioned about one or both pivot points and could be used to supply additional restoring force to the shunt.

It is understood that the invention is not limited to the particular construction and arrangement of parts herein illustrated and described, but embraces such modified forms thereof as come within the scope of the following claims.

I claim:

1. An automobile mounted tilt and acceleration sensor comprising:

a housing;

a reed switch mounted on the housing;

a magnet mounted to the housing, positioned vertically spaced from the reed switch, the magnet producing a magnetic field sufficient to cause the reed switch to actuate;

a magnetic shunt mounted to the housing by a pendulum with a pivot point vertically above the reed switch and the magnet, the shunt positioned to hang between the reed switch and the magnet, the magnetic shunt mounted to swing through an arc centered between the reed switch and the magnet, the shunt preventing actuation of the reed switch when it is positioned between the magnet and the reed switch;

two opposed shunt stops mounted on the housing and positioned to allow the shunt to swing out from between the reed switch and the magnet along the arc;

a selected pendulum mass coincident with the shunt; and a means for biasing the shunt between the reed switch and the magnet having a selected restoring force, wherein the pendulum mass is selected such that gravity acting on the selected mass is greater than the selected restoring force, when the housing is tilted beyond a selected angle, and wherein the stops are positioned to position the shunt so that the means for biasing can move the shunt to a position between the magnet and the reed switch when the housing is returned to a vertical position.

2. The sensor of claim 1 wherein the means for biasing the shunt is the magnet.

3. The sensor of claim 1 wherein the pendulum mass is formed by the shunt.

4. The sensor of claim 1 wherein the magnet has two poles and wherein both poles face the reed switch.

5. The sensor of claim 1 wherein the pendulum is formed of a nonmagnetic material.

6. The sensor of claim 1 wherein the housing comprises two mating portions which position and hold the magnet, the reed switch, and the pendulum, and a cover which encloses the two mating portions.

7. A tilt sensor comprising:

a housing;

a reed switch mounted to the housing;

a magnet mounted to the housing above the reed switch;

a ferromagnetic shunt member positioned above the reed switch; and at least one pendulum arm which extends upwardly from the shunt member to a pivotal mounting on the housing at a position above the magnet, the shunt member being mounted by the at least one pendulum arm for swinging movement on the housing between a position where the shunt member is interposed between the magnet and the reed switch, and an activated position where the shunt member is not interposed between the magnet and the reed switch, wherein the at least one pendulum arm is mounted to the housing such that the shunt member may swing freely to move out of interposition between the magnet and the reed switch by travel in a first direction and a second opposite direction.

8. The reed switch of claim 7 wherein the shunt member is biased by magnetic attraction between the magnet and the shunt in the position where it is interposed between the reed switch and the magnet.

9. The reed switch of claim 7 wherein the shunt member is mounted by two pendulum arms to the housing, and the magnet is located on the housing between the pendulum arms.

10. The reed switch of claim 7 wherein the housing comprises:

a base to which the reed switch is mounted;

a magnet housing to which the magnet is mounted, the magnet housing being connected to the base, and wherein pendulum arm pivot supports are defined by the base, the pendulum arms being pivotally mounted thereon; and a cover which encloses the connected base and magnet housing.

11. The reed switch of claim 10 wherein the magnet housing has a flexibly mounted arm which retains the magnet on the housing in a snap fit.

12. The reed switch of claim 10, wherein the magnet housing comprises:

a pocket which engages the magnet;

two vertical supports which extend upwardly to a position above the pocket; and a cross beam which extends between the vertical supports, wherein the pocket depends from the cross beam.

* * * * *